US006398698B1

(12) United States Patent
Hinds

(10) Patent No.: US 6,398,698 B1
(45) Date of Patent: Jun. 4, 2002

(54) ADJUSTABLE EXERCISE HANDGRIP ASSEMBLY

(76) Inventor: Robert Sylvester Hinds, 1803 Regent St., Madison, WI (US) 53705

( * ) Notice: Subject to any disclaimer, the term of this patent is extended or adjusted under 35 U.S.C. 154(b) by 0 days.

(21) Appl. No.: 09/388,228

(22) Filed: Sep. 1, 1999

Related U.S. Application Data

(63) Continuation-in-part of application No. 09/243,087, filed on Feb. 2, 1999, now abandoned.

(51) Int. Cl.[7] ..... A63B 21/02

(52) U.S. Cl. ..... 482/126; 482/124; 482/141

(58) Field of Search ..... 482/126, 124, 482/49, 121, 130, 142, 129, 148, 907, 904; D21/692, 691

(56) References Cited

U.S. PATENT DOCUMENTS

| | | | | |
|---|---|---|---|---|
| 196,324 A | | 10/1877 | Barnett | 482/126 |
| 232,579 A | | 9/1880 | Weeks | |
| 1,112,114 A | | 9/1914 | Caines | |
| 1,749,544 A | * | 3/1930 | Pagano | 482/126 |
| 1,965,511 A | | 7/1934 | Preston | |
| 2,118,114 A | * | 5/1938 | Schenk | 482/126 |
| 4,109,907 A | | 8/1978 | Zito | 272/117 |
| 4,251,071 A | * | 2/1981 | Norton | 482/126 |
| 4,779,867 A | | 10/1988 | Hinds | 272/137 |
| 5,505,677 A | | 4/1996 | Hinds | 482/10 |
| 5,549,532 A | | 8/1996 | Kropp | 482/126 |
| 5,681,243 A | * | 10/1997 | Criss | 482/126 |
| 5,681,248 A | | 10/1997 | Vani | 482/126 |
| 5,775,756 A | * | 7/1998 | Rozenich | 482/106 |

FOREIGN PATENT DOCUMENTS

| | | |
|---|---|---|
| GB | 27611 | 2/1899 |
| GB | 116404 | 9/1900 |

* cited by examiner

*Primary Examiner*—Jerome Donnelly
(74) *Attorney, Agent, or Firm*—Loyd W. Bonneville

(57) ABSTRACT

An exercise handgrip assembly comprising an elastic exercise member impinger which seats in a channel nest, thereby allowing the operator to reliably adjust the length of the elastic member to vary the exercise routine. Stowage means are also provided to secure the impinger from loss or misplacement. The assembly further comprises embodiments of rotable palm holds.

16 Claims, 8 Drawing Sheets

ADJUSTABLE EXERCISE HANDGRIP ASSEMBLY

CROSS-REFERENCE TO RELATED APPLICATION

This application is a continuation in part of U.S. patent application Ser. No. 09/243,087 filed Feb. 2, 1999 (now abandoned).

FIELD OF THE INVENTION

Exercise equipment

DESCRIPTION OF THE PRIOR ART

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term elastic member impinger tethering loop (33) might be used in one instance but in another, if meaning is otherwise clear from context, expression might be shortened to impinger tethering loop (33) or merely loop (33). Any of those forms is intended to convey the same meaning. The term attach or fasten or any of their forms when so used means that the juncture is of a more or less permanent nature, such as might be accomplished by nails, screws, welds or adhesives. Thus, it is stated herein that strapping (600), stitched in fastening loops at its (600) ends, is attached to the connection bar (21). A connection in which one object is easily removed from another is described by the word emplace, as where it is stated herein that an impinger (2) is emplaced in the channel nest (5) before tugging an elastic member (200, 201, 200) against it. Employment of the words connect or join or any of their forms is intended to include the meaning of both in a more general way.

The term rigid emplacement denotes a connection other than by attachment which, nevertheless, permits separation only with great difficulty or torturous manipulation. It is accordingly stated herein that the joining of a connecting node (62) of a handgrip stirrup (61) with a connecting well (65) of a rotable palm hold (64) is one of rigid emplacement.

The word comprise may be construed in either of two ways herein. A generic term used to describe a given one of a number of specific elements is said to comprise it, thereby characterizing the specific element with equivalency in meaning for the generic term. Thus, an impinger tether (4) may be said to comprise a tethering loop (33), meaning that in the particular case, the tether (4) is such a loop (33). However, the word comprise may also be used to describe a feature which is part of the structure or composition of a given element. Thus, an adjustable strapped handgrip assembly (20) may be said to comprise a connection bar (21), meaning that the structure of the handgrip assembly (20) is such as to have the connection bar (21) as a feature of its structure. The meaning in the respective cases is clear from context, however. Accordingly, modifying words to clarify which of the two uses is the intended one seem unnecessary.

The terms strapped and semi-rigid stirrup or any of their root variations as employed herein with reference to handgrip assemblies (1) denote the physical character thereof.

By strapped is meant the features provided for the most part by fabric materials subject to bending or folding. Handgrip strapping (600), for example, provides what is characterized in that sense. A prior art strapped handgrip

(400) might, therefore, comprise a strap (600) run through a tubular palm hold (302) and connection means would be included at the point it (400) is joined by an elastic exercise cord (200) or other elastic member (201, 202).

A rigid stirrup handgrip (300), well known to prior art, might well be of solid one piece construction or might, on the other hand, similarly comprise a tubular hold (302). Foam padding might be provided for either type.

The term semi-rigid defines a object lacking pliability in general but which, although comprising significant resistance to bending, nevertheless, permits a lesser degree thereof. Thus, a handgrip assembly comprising semi-rigid stirrup configuration (10) allows its stirrups (61) to be bent slightly so that the distance between the tips is increased to allow the insertion of a rotable palm hold (64) therein.

The expression rotable when employed herein, or derivations of its word root, refers to structure which confers upon a given palm hold (64, 302) the property of axial rotation, or longitudinal spin. The tubular palm hold (302) of prior art, whether installed upon the enclosed stirrup of a rigid stirrup handgrip (300) or the strapping (600) of a strapped handgrip (400), comprises such property or function. So configured, those handgrips (300, 400) facilitate exercise, since without it (302), the operator (100) would be required often to shift his (100) or her (100) hands upon the handgrip (300, 400), as is indeed the case when grasping a one-piece rigid stirrup handgrip palm hold (301).

The terms interior and exterior when applied to a handgrip assembly (1) designates the portion of the grip identified with reference to the assembly's (1) shape. Thus, the exterior channel end (8), ante, refers to the part of the channel (6) the elastic member (200, 201, 200) first penetrates at its (200, 201, 202) interface with a grip (300, 400). Running the member (200, 201, 200) through the channel (6) allows it to emerge at the opposite end thereof (6) referred to as the interior one (7). The interior end of the channel (6) is, thus, that which is inside a grip's (300, 400) enclosed D-ring configuration. However, the words interior and exterior also are used equivalently with those of inboard and outboard. For example, in discussing the features of the connection bar (21) ante, those objects nearer the center thereof (21) are considered interior and those more remote thereto, exterior.

Rigid stirrup handgrips (300) comprising a U-shape and palm hold (301), together with cording of one sort or another have been well known for many decades. Even the substitution of elastic material for the cording, a break from traditional weight raising assemblies, now occupies a secure place in prior art. Handgrip (300, 400) and elastic exercise member (200, 201, 202) interface raised a challenge for a time, however. To avoid risk of injury, a cord expanding impinging plug (500) has successfully been employed by running a hollow cord (200) through an aperture in the handgrip (300, 400), forcibly fitting into its (200) end a plug (500) and then tugging it (200) back through the handgrip (300, 400) such that the part of it (200) containing the plug (500) butts securely against the grip (300, 400).

Materials now extant provide greater wear resistance to a cord (200) or other elastic exercise member (201, 202) and additional friction to prevent slipping. More recently, fabric strapping (600) has been employed to create a more flexible handgripped device usually comprising foam enwrapment for palm hold (301) comfort.

Elements other than the hollow cord (200) which are commercially available include elastic sheet (201) and elastic strap (202). Impinging plugs (500) cannot be employed with them (201, 202) because they (201, 202) comprise no site in which a plug (500) can be installed such as the hollow tubing of exercise cord (200). Experience has shown, however, that elastic sheet (201) is also used therapeutically with considerable success. For example, an operator (100) may wrap the sheet (201) around an injured limb to exercise it.

The security of an elastic exercise member, whether cord (200), sheet (201) or strap (202), has been but one of the problems, however. The operator (100) derives considerably more benefit if the member's (200, 201, 202, respectively) length can be changed to suit individual needs. It is well recognized that an shorter elastic member (200, 201, 200) provides increased tension and a longer one (200, 201, 200) relaxes it. For some purposes, the former is desirable, while for others, the latter is. To avoid allowing some muscles to become stale, a mix of tensions during an exercise activity is always best.

The term effectual length, is used herein with reference to adjustments in length to an elastic exercise member (200, 201, 202). Of course, the actual length of the member (200, 201, 202) is fixed. The effectual length thereof is that which remains after adjustment, described ante, for active exercise use.

In many instances, elastic member (200, 201, 200) interchangability can be equally important to its (200, 201, 202) length adjustment. For example, if an operator (100) wished to exercise for a time with a member (200, 201, 202) of more or less elasticity, it would be extremely helpful if the mechanism in use permitted a quick interchange. The same would be true for an operator (100) of modest physical capabilities such as might be possessed by a child, many—but certainly not all—females or those males who prefer an easier-to-pull elastic member (200, 201, 200). Should such an operator (100) wish to employ the equipment after use by another (100) for whom more turgidity was favored, convenience in interchangability becomes a very useful feature. Elastic members (200, 201, 200) are currently available in a variety of degrees of resiliency and color coded for such purpose.

Where elastic member (200, 201, 200) interchangability is sought for, of course, both ends thereof (200, 201, 200) must be separated from the handgrip assembly (1). Where, on the other hand, mere length adjustment is operably undertaken, only one end of the elastic member (200, 201, 202 need be manipulated. The other end may be knotted or, if comprising hollow cord (200), stoppered by the impinging plug (500) known to prior art.

Where elastic exercise exercise members (200, 201, 202) are concerned, therefore, there are two objectives which present an innovative challenge: Length adjustment and interchangability. It should be recognized, incidentally, that in order to provide quick interchangability to a hollow elastic cord (200), it (200) must not be stoppered by an impingement plug (500). Any such plug (500) suited to its (500) purpose, is too deeply embedded within the cord (200) to be removed without great difficulty.

In the same way elastic exercise member (200, 201, 202) length adjustment and interchangability have become important, so too has the matter of economical manufacture of a handgrip assembly (1) comprising reliable palm hold (301, 302) rotability and ease of assembly. While the tubular rotable palm hold of prior art (302) provides sufficient rotability, difficulties in manufacture are inherent, not unlike those of the well known ship in a bottle or the woodcarving of a sphere within a cage. If, for example, one wishes to manufacture a tubular rotable palm hold (302) upon a prior art rigid stirrup handgrip (300), it will probably become necessary either to render the stirrup of the handgrip (300) in two pieces and reattach them following emplacement of the tube or to split the palm hold (301) longitudinally and force it (301) somehow upon the handgrip (300) such that it (300) recovers the tubular shape it (301) previously comprised but momentarily lost during assembly. The manufacture of a tubular palm hold (302) for a strapped handgrip (400) is, of course, less challenging requiring only that it (302) be emplaced prior to stitching up the looped ends of the handgrip strapping (600).

In either case, however, whether the manufacture of a tubular palm hold (302) has to this time been conducted upon a rigid stirrup handgrip (300) or a strapped one (400), it is not feasible to replace it (302) if broken or otherwise damaged. Thus, should even the foam enwrapment encircling it (302) become useless because of wear or tearing, applicant is aware of no previous satisfactory restorative solution for the problem. What is required is a handgrip assembly (1) for which a palm hold (301) is made rotable while firmly connected to a rigid handgrip stirrup (300) but, nevertheless, separable from it (300) in some manipulative manner, albeit with sufficient difficulty that it cannot accidently occur during use.

Objectives to a truly useful handgrip assembly (1), therefore, should ideally address all three of the addressed objectives—quick length adjustment of the elastic exercise member (200, 201, 202), facilitated interchangability thereof (200, 201, 200) and rigid stirrup palm hold (301) rotability and disassembly.

U.K. Patent No. 27,611 issued to Bussey is characteristic of the first approaches to cord —handgrip (300, 400) interface. Because inelastic cord was employed, mere knotting was considered sufficient. U.K. Patent No. 16,404 issued to Wieland; U.S. Pat. No. 1,112,114 issued to Caines and U.S. Pat. No. 1,965,511 issued to Preston featured hooks and eyelets to that end.

U.S. Pat. No. 196,324 issued to Barnett features a 19th Century solution to the jump rope connection interface problem in which an inelastic cord is doubled over and embedded within a plug (500) which is glued in place, the opening being merely capped off with a sealing plug. U.S. Pat. No. 232,579 issued to Weeks illustrates a braided rope connection to rigid stirrup handgrips (300) with a system of snap-hook connections at intermediate places along a series of interconnected cords (200). U.S. Pat. No. 4,109,907 issued to Zito illustrates a metallically clamped doubled over cord (200). U.S. Pat. No. 4,779,867 issued to Hinds, also the applicant herein, illustrates rigid stirrup handgrips (300) secured by impingement plugs (500) inserted within the tubular elastic cord (200). U.S. Pat. No. 5,681,248 issued to Vani provides strapping (600) for a strapped handgrip (400) with foam enwrapment for a tubular palm hold (302) and plug (500) stoppered elastic tubing (200) run through grommets. None of the foregoing permit either length adjustment or interchangability of the elastic exercise member, whether cord (200), sheet (201) or strap (202).

Two patents of greater interest have emerged, however: U.S. Pat. No. 5,505,677 issued to Hinds, also the applicant herein, and U.S. Pat. No. 5,549,532 issued to Kropp. Both patents disclose what is described herein, ante, as an elastic exercise member impinger.

The claims of the Hinds patent addressed innovations therein other than an object dedicated to impingement of an elastic exercise member (200, 201, 200). The impinger (3), however, is presented therein only as a drawing without elaboration and, therefore, of undeterminable merit. In its (3) present form as set forth herein, one readily observes its (3) real structure and importance. It (3) comprises a significant improvement to what was disclosed therein.

The Kropp patent was issued based upon claims addressing an impinger of sorts (701). There is no specific reference to a configuration which is spherical (91) or to one which is, for example, lozenge shaped (92), a truncated sphere (93), ovate (94)—that is, like an egg—or bean shaped (95). These configurations are further addressed herein but are generally recognized for what they are by most.

Because the object (701) claimed in the Kropp patent is merely "ball-shaped", it remains unclear whether anything beyond an amorphous mass, for which the term "ball" is frequently used in colloquial parlance, was intended. Kropp also claimed "locking means" which are unsupported by antecedent precedent in the disclosure. In short, there appears both in the disclosure and drawings therein antecedent support only for a shape which is designated therein as "frusto-conical"—that is, a truncated cone.

Experience has demonstrated that an elastic exercise member (200, 201, 202) impinged upon by an emplaced conical object, truncated (701) or otherwise, even in a tapered nest (100) as shown in Kropp, tends to become unsuitably abraded where at the seating situs it (200, 201, 200) is borne upon by the object's (701) angular edges. The property of roundness or arcuitry for the edge which contacts the elastic exercise member (200, 201, 202) in impingement would, if provided, be highly preferred to the straightness comprised by a truncated cone (701).

Arcuate or rounded configuration would permit the impinger (3) to contact the elastic member (200, 201, 200) in a manner less likely to abrade it (200, 201, 200) by reason of sharp marginal edges such as those comprised by the truncated cone shaped one (701)—sometimes referred to as "frusto-conical"—of prior art. An arcuate or rounded edge would also seat against the elastic member (200, 201, 200) in an optimum manner, depending upon the mutual positioning of the two (3 and 200, 201, 202, respectively), whereas the straight edge of prior art comprised by a truncated cone (701) necessarily seats in singular fashion—always along its (701) straight side. An arcuate edge would, if provided, comprise the highly beneficial property of seating against the elastic member (200, 201, 200) within the elastic exercise member channel (6) along a circumferential line comparable to the latitude lines or equator of a globe.

Applicant has resolved that the distinct advantages of employing an elastic exercise member impinger (3) comprising a rounded or arcuate exterior should be brought to public attention.

While the historical developments supra have fairly well addressed the matter of elastic cord (200) and handgrip (300, 400) interface for security purposes, the problems of quickly adjusting length of any elastic exercise member, whether cord, sheet or strap (200, 201, 202, respectively) or interchanging one of them (200, 201, 200) for another (200, 201, 202) and palm hold (301, 302) rotability and disassembly for rigid stirrup handgrips (300) remain. The needs or objectives pointed out supra thus far remain only partly addressed in the prior art. Some, such as that just immediately addressed, have not been met at all.

SUMMARY OF THE INVENTION

The invention is an exercise handgrip assembly (1) having application to either of two adjustable subassemblies, each derived in part from prior art—the first comprising semi-rigid stirrup configuration (10) and the second, strapped configuration (20) wherein handgrip strapping (600) is employed.

One of the invention's main features comprises a member impinger (3) for use in quickly and conveniently adjusting the effectual length of an elastic exercise member (200, 201, 200) secured between the handgrip assembly (1) pair or interchanging such members (200, 201, 200). The impinger (3) becomes seated in a nest (5) disposed within the member channel (6) such that it (3) squeezes against the elastic member (200, 201, 202) and is retained there (5) during exercise.

In an adjustable handgrip assembly comprising semi-rigid stirrup configuration (10), the prior art fully tapered nest (100) or parallel walls of the elastic member channel is modified to provide any one of a number of improved nests (5) comprising configurations including concave (51), convex (52) or partially tapered (53).

In an adjustable handgrip assembly comprising strapped configuration (20), the nest (5) reposes within an elastic exercise member channel (6) disposed within a connection bar (21) configured also to both accommodate the handgrip's strapping (600) and provide a situs for elastic member (200, 201, 202) security. It is the impinger's head (31), comprising any of a variety of arcuately edged configurations—spherical (91), lozenge shaped (92), truncated sphere (93), ovate (94) or bean shaped (95)—which accomplishes the impinging task.

In addition to the head (31), the elastic member impinger (3) also comprises a stem (32) and impinger tether (4). The latter (4) is configured either with a tethering loop (33) and impinger connector guide (34) combination or with a tethering stop (43).

The invention also comprises a rotable palm hold (64) for use upon an adjustable handgrip assembly comprising semi-rigid stirrup configuration (61). The palm hold (64) and stirrup (61) are so configured that the two (64, 61) may be firmly joined in manufacture by means of rigid emplacement as that term is defined herein. The palm hold (64) may be fitted in manufacture with either a foam sleeve (10) or one comprising a rigid shell (71).

A rotable longitudinally split shell sleeve (81) is also featured herein which may be rigidly emplaced upon a one-piece handgrip (300) of the sort known to prior art

BRIEF DESCRIPTION OF THE DRAWINGS

Solid lines in the drawings represent the invention. Dashed lines represent either noninventive material; that not incorporated into an inventive combination hereof; or that which although so incorporated, lies beyond the focus of attention.

DESCRIPTION OF THE PREFERRED EMBODIMENT

Figure 1:
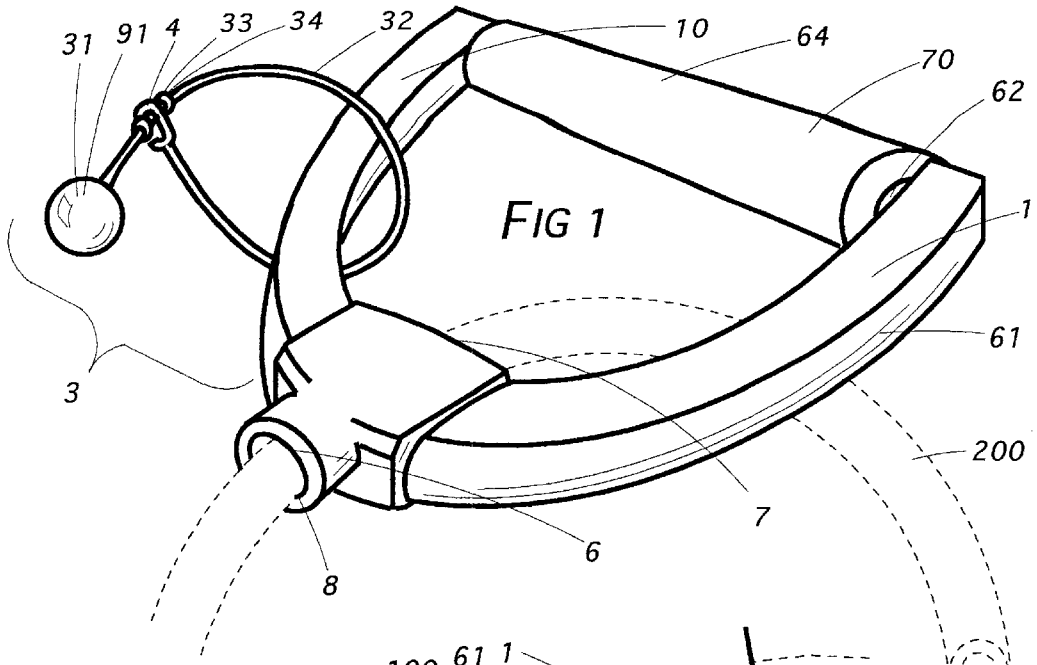
FIG. 1 depicts in perspective an adjustable handgrip assembly comprising semi-rigid stirrup configuration (10), a rotable palm hold (64) and an elastic exercise member impinger (3) configured with a spherical head (91) and an impinger tether (4) comprising a tethering loop (33) encircling the handgrip stirrup (61).

The subject of this application is an exercise handgrip assembly (1) specifically comprising either of two types of adjustable subassemblies—the first comprising semi-rigid stirrup configuration (10) and the second strapped configuration (20). Both (10, 20) are derived from prior art handgrips—configured either rigidly in one piece (300) or strapped (400)—but by reason of the matters addressed herein, respectively comprise significant features of improvement.

The characteristics of novelty comprise in part means by which the effectual length of the elastic exercise cord (200), sheet (201) or strap (202) of an exercise assembly may be quickly adjusted—that is, either shortened or lengthened—or interchanged with others of varying elasticity. Adjustment of the elastic member's (200, 201, 200) effectual length is accomplished by inserting one of its (200, 201, 202) ends through the handgrip's elastic exercise member channel (6), ante—into the exterior elastic member channel end (8) and out the interior elastic member channel end (7)—and then impinging it (200, 201, 200) securely at a point along its (200, 201, 202) midlength. A portion of its (200, 201, 200) length is thereby removed from active use and merely allowed to stick out, or hang loosely from the assembly. The remaining portion of the elastic member (200, 201, 200), extending between the handgrips of either assembly (1), is available for active use.

The essential parts of this feature of the invention, whether derived from an assembly comprising semi-rigid stirrup configuration (10) or one comprising the strapped variety (20), comprise an elastic member impinger (3) and an elastic member channel nest (5) disposed within a member channel (6).

In certain respects, the assembly comprising semi-rigid stirrup configuration (10) conforms well to the prior art one-piece rigid stirrup handgrip (300). While both comprise an elastic member channel (6), the essential difference is the presence, where included, of a channel nest (5) in the former. True, the rigidly configured prior art model (300) would provide an almost adequate seating site for an elastic member impinger (3) allowed to become embedded within the channel (6) for impingement purposes. One can readily conceive of even the straight walled channel of such a handgrip (300) as containing both the penetrating elastic cord (200) or other elastic member (201, 202) and impinger (3) so as to provide sufficient squeezing force to retain the cord (200) or member (201, 202) in place. It should be readily apparent, of course, that the nest (5) provides considerably greater impinging security.

Figure 3:
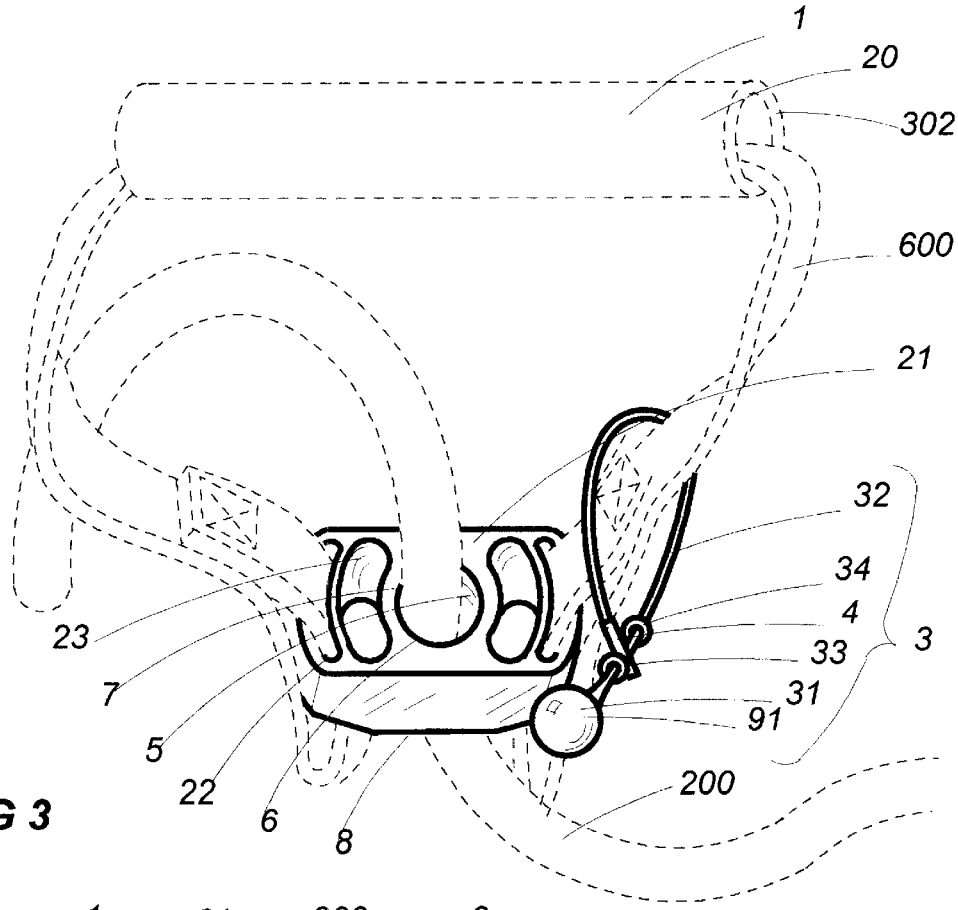
FIG. 3 is a perspective view of an adjustable strapped handgrip assembly (20) featuring a connection bar (21) providing in addition to the impingement means referred to supra regarding FIGS. 1 and 2, means also for attachment of the handgrip strapping (600). A prior art tubular palm hold (302) is included.
Figure 4:
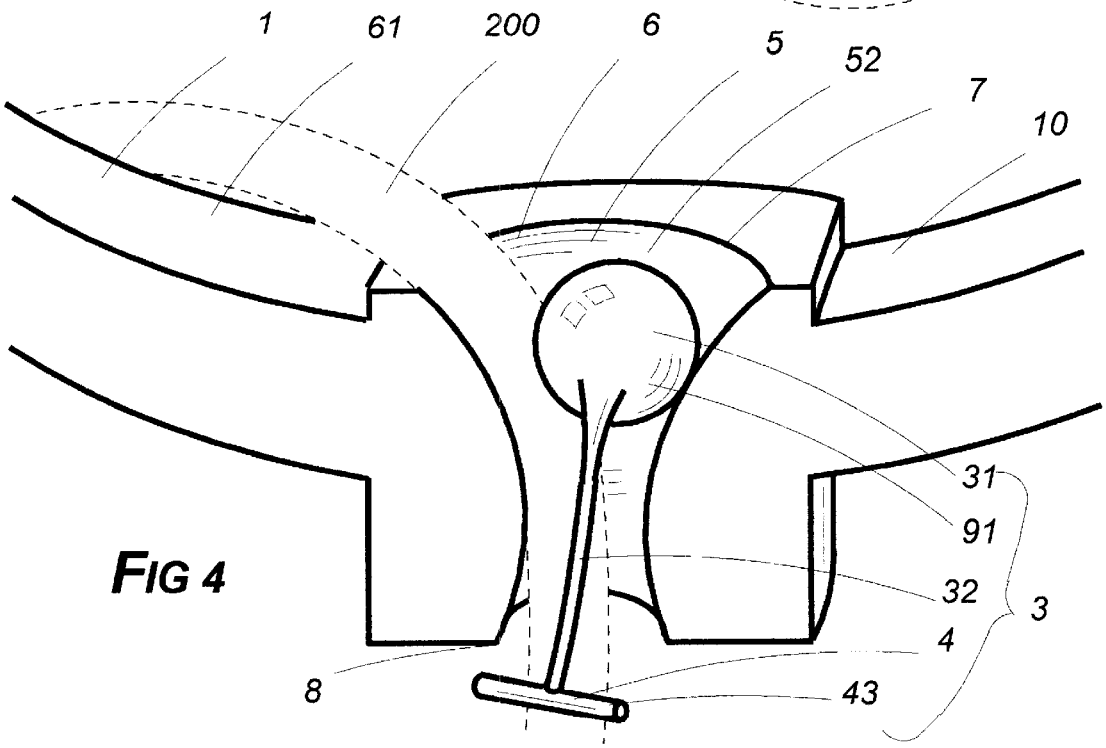
FIG. 4 comprises a cutaway view of a convexly configured elastic exercise member channel (6) disposed in a handgrip assembly comprising semi-rigid stirrup configuration (10). As in the foregoing, an elastic exercise member impinger (3) configured with a spherical head (91) is also included. The impinger (3), however, is shown to comprise a tethering stop (43) as the impinging tether (4), however.
Figure 5:
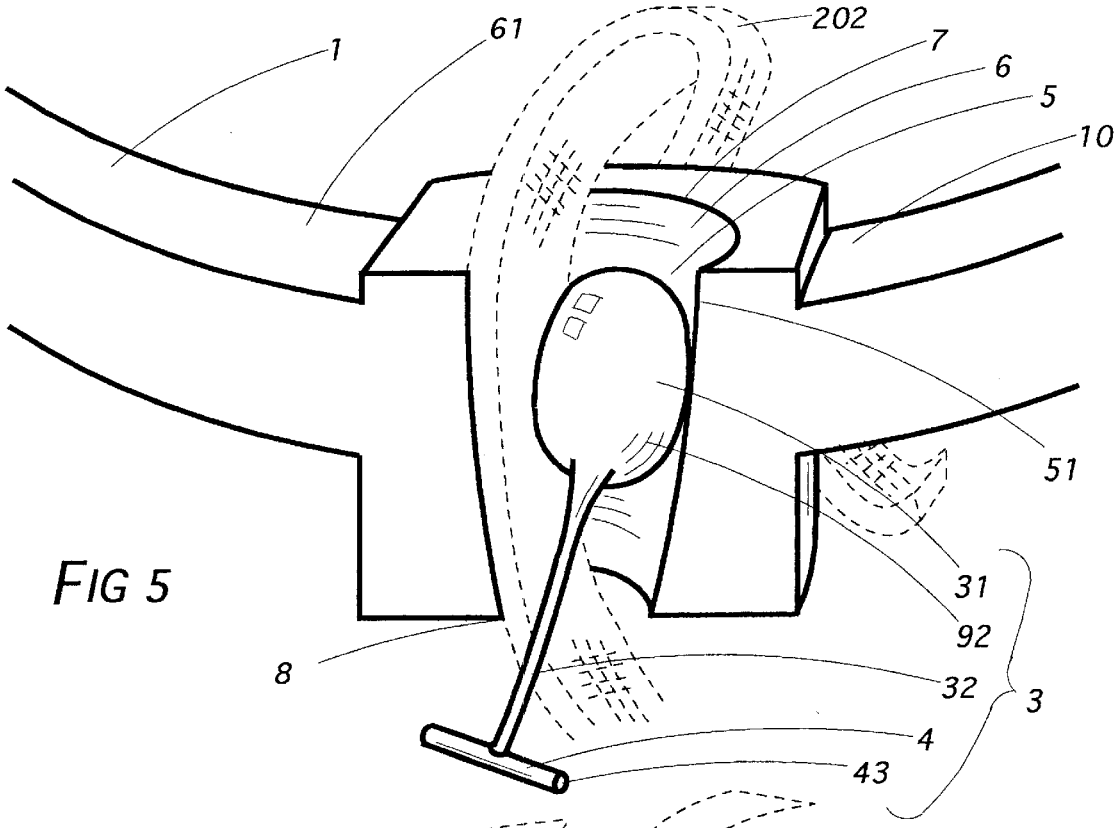
FIGS. 5 and 6 represent cutaway views of adjustable semi-rigid stirrup handgrips featuring impingers (3) comprising, respectively, heads (31) configured in lozenge shape (92) and that of a truncated sphere (93), impinging nests (5) as concave (51) and partially tapered (53) and elastic members of elastic strap (202) and elastic sheet (201) in lieu of cording (200).
Figure 6:
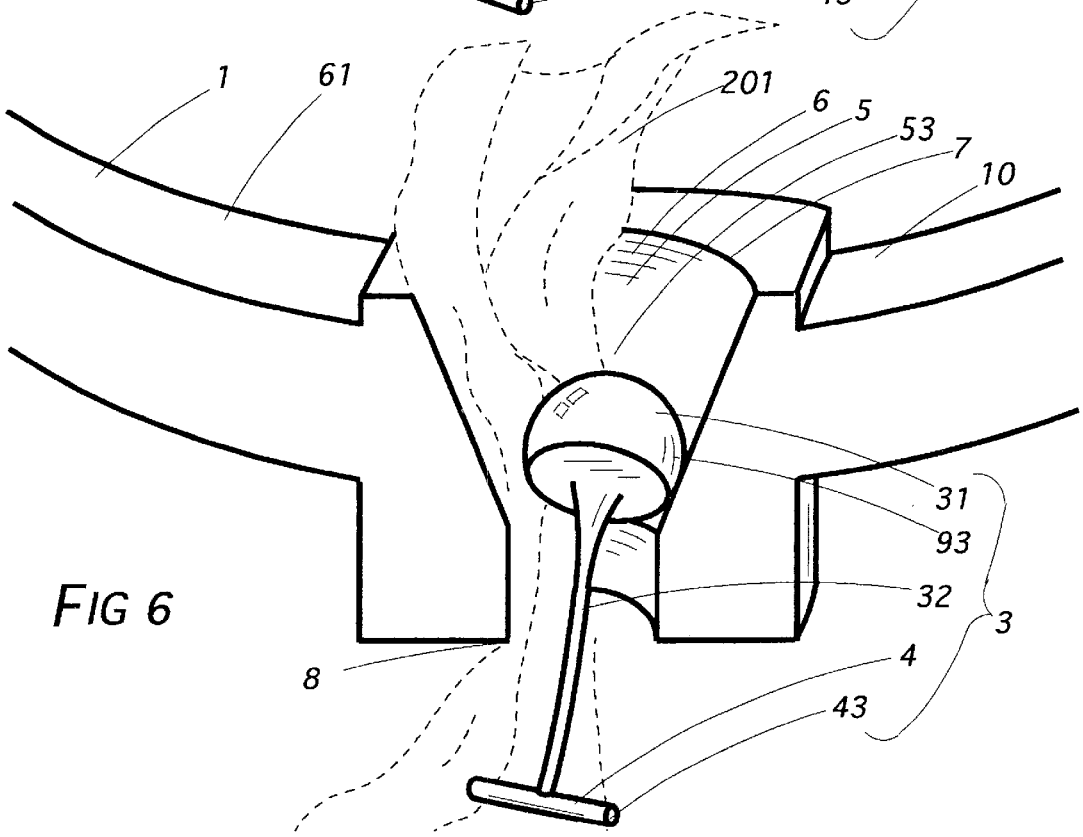
Figure 9:
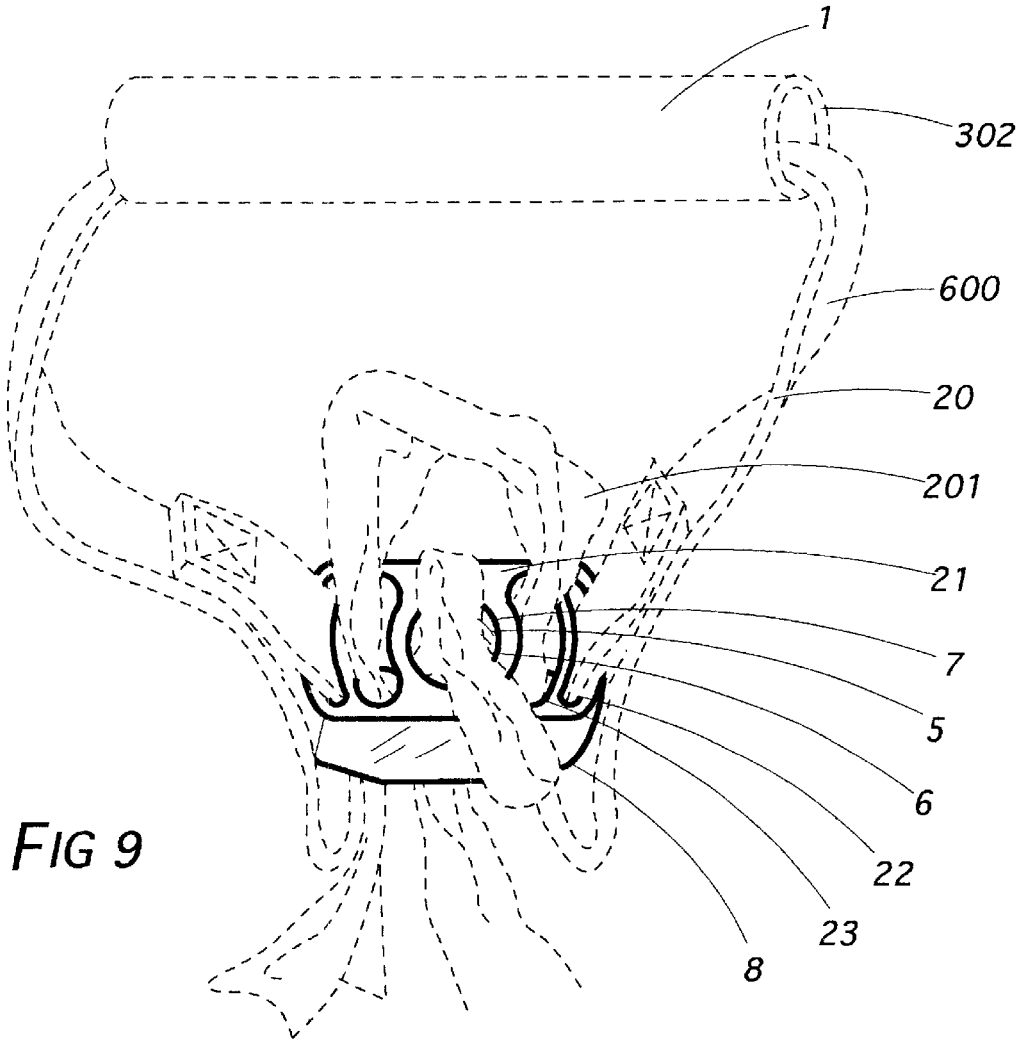
FIG. 9 depicts means alternative to that of impingement by which the elastic member—exercise sheet (201) in the particular case—may be secured to connection bar (21) of an adjustable strapped assembly (20).
Figure 10:
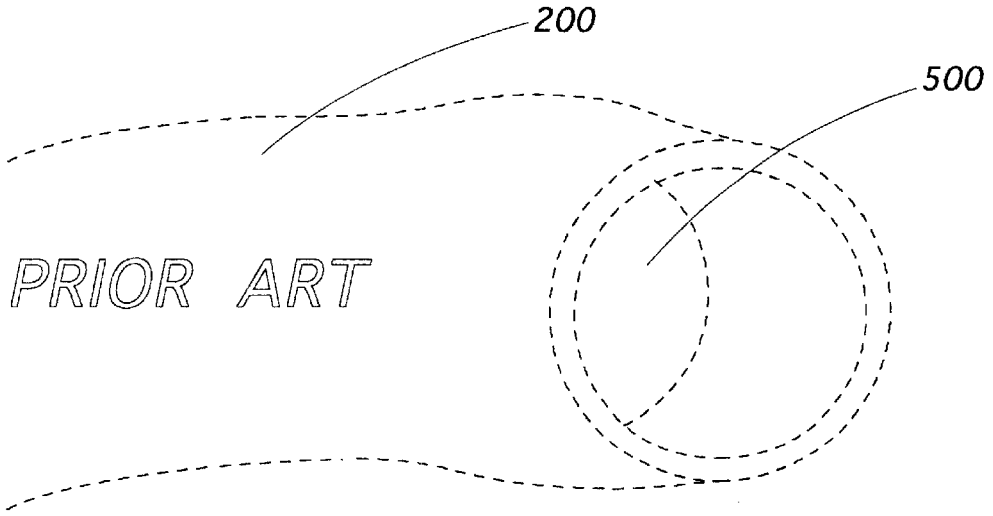
FIG. 10, a prior art rendering, illustrates the manner in which an impinging plug (500) is disposed in rigid emplacement within the end of an elastic exercise cord (200)

The derivation of the adjustable handgrip assembly comprising strapped configuration (20) from the strapped handgrip (400) of prior art comprises a departure therefrom (400) primarily in employing a connection bar (21). As illustrated in FIGS. 3 and 9, this constituent of the invention provides a solid situs wherein are present opposing pairs of strap channels (22) and securing channels (23) together with the same elastic member channel (6) and nest (5) in the assemblies comprising semi-rigid stirrup configuration (10) addressed supra.

The opposing pair of strap channels (22) provide conduits through which, in manufacture, the handgrip strapping (600) may be run and stitched in loops to keep it (600) in place as in FIGS. 3 and 9.

As with the strap channels (22), the opposing pair of securing channels (23) also provide openings through which the elastic exercising member, whether cord (200), sheet (201) or strap (202), may be interlaced from one channel (23) to the other (23) as in FIG. 9 so as to provide sufficient elastic friction to dependably retain the member (200, 201, 200) during exercise. To serve that purpose suitably and as the drawings show, the securing channels (23) are preferably wider than the strap channels (22). The breadth of the securing channels (23) must be sufficient to permit drawing the elastic member (200, 201, 202) through them (23) without great difficulty. The interlacing operation also provides a convenient place in which the ends of the elastic member (200, 201, 200) ends may be tucked in stowage and kept out of the way during exercise.

FIGS. 3 and 9, those illustrating the adjustable handgrip assembly comprising strapped configuration (20), also include a tubular palm hold (302), a prior art ingredient, enwrapped in foam. Since stitching is shown to have been employed to attach the strapping (600) there, the palm hold (302) is easily mounted in place during manufacture but afterwards impossible to remove without undoing the stitching or cutting the strapping (600). The tubular configuration permits the hold (302) to spin, or rotate, upon the strapping (600) extending through it (302).

The combination of elastic member impinger (3) and member channel nest (5) embody a crucial feature of the invention in providing the impingement required to effectually lengthen or shorten the elastic exercise member (200, 201, 200). Exercise stresses upon the handgrip assembly (1) during use by the operator (100) tend to strengthen the impingement. The harder the elastic member (200, 201, 202) is pulled, the tighter the interface connection becomes.

The part of the impinger (3) which provides the impingement comprises an impinger head (31), a knob-like structure which merely by reason of its (31) mass is caused to bear against the elastic member (200, 201, 200) extending through the member channel (6) when tugged through at the channel's exterior end (8). Pushing the elastic member (200, 201, 202) in the opposite direction—from the channel's exterior end (8) to its interior end (7)—releases the impinger head (31) from the nest (5) so that the member (200, 201, 200) may be operatively changed in effectual length or, provided the same operation is conducted upon the other handgrip assembly (1), interchanged with another member (200, 201, 200).

The head (31) may be configured in any number of ways including spherical (91), lozenge shape (92), truncated sphere (93), ovate (94) and bean shape (95). The spherical shape (91) is, of course, well recognized as an object having equal radius in all directions. Lozenge shape (92), as used herein, defines that portraying elongated longitudinal symmetry such as comprised by an ellipse or oval. A truncated spherical shape (93) depicts that of a sphere which has a portion comprising that disposed between a cross section and the end thereof—such as a hemisphere, for example. Another example may be visualized by severing a globe in two parts along any one of its latitude lines, such that the two parts are unequal. Ovate (94) configuration comprises that which is egg shaped—elongated but lacking longitudinal symmetry in that the cross sectional diameter is greater at one end than the other. By bean shaped (95) configuration is meant that which is longitudinally curved—sometimes referred to as "kidney shaped"—comprising two sides which are generally parallel in concavity. All of these comprise in common a feature crucial to the invention—an arcuate outer edge.

Functionally, the impinger's head (31) is all that is required to provide interface security. However, if the member impinger (3) comprised nothing more, it (3) would easily become lost or misplaced. The impinger (3), therefore, has been additionally configured with structure to secure itself (3) to the handgrip assembly (1), whether of the semi-rigid stirrup or strapped sort (10, 20, respectively).

The impinger tether (4) comprises any means known to prior art required for connecting various relatively small objects for stowage purposes. Each of those depicted in FIGS. 1–3 comprise an impinger tethering loop (33) which is operably looped around a convenient part of the handgrip assembly (1) and then secured, somewhat resembling a lariat, or lasso, in appearance. It is preferable that the size of the loop (33) be small enough to prevent its (33) slipping away from a handgrip stirrup (61) it (33) is tethered to and to which (61) the rotable palm hold (64), ante, is not connected. The size of the loop (33) is controlled by the disposition of the impinger connector guides (34) along the stem (32).

Each (4) shown in FIGS. 5–8 and 11, however, comprises an impinger stop (43), a T-shaped structure which by reason of its (43) transverse cross member—the head of the T, so to speak—provides the required security by blocking passage through the channel (6) in which the impinger (3) is disposed. Although differing considerably in size and function, in certain respects, this part of the structure (43) resembles the smaller plastic price and size tag connectors one finds in retail clothing.

The impinger stop (43) shown is merely rod-shaped but may, in fact, take any one of several forms. It (43) may, for example, be somewhat planular or disk-shaped. It is the transversity, not the shape, which provides the necessary anchoring character.

Since the function the stop (43) serves is merely that of stowage, so as to avoid becoming lost or overlooked, it (43) need not be as durable in structure as are the parts of the exercise assembly subjected to extreme tensions. Nevertheless, the material of which the stem (32) and it (43) are comprised must be adequate to perform their (32, 43) intended function. First, the two parts (32, 43) must be allowed to bend without breaking at their (32, 43) mutual joint so as to permit insertion through the elastic exercise member channel (6). Second, they (32, 43) must be flexible enough to spring back into their (32, 43) mutually transverse configuration. Finally, the stop (43) must be strong enough to afterwards remain in place without becoming accidentally pulled through the channel (6). These requirements are fairly obvious for the shorter stemmed elastic member impinger (3) with its (3) T-shaped stop (43) for an impinger tether (4). However, an impinger (3) with sufficient elongation in the stem (32) to permit anchoring it (32) around a part of the handgrip assembly (1) by means of its tether (4) comprising a tethering loop (33) is subjected to similar stresses.

For the foregoing reasons, it is important that the elastic member impinger (3) be comprised of tested materials. Table I lists such properties for Polypropylene PP5420, 20% glass reinforced, chemically coupled homopolymer. Table 11 lists them for Rexene PP 18S2A Polypropylene Copolymer.

Figure 2:
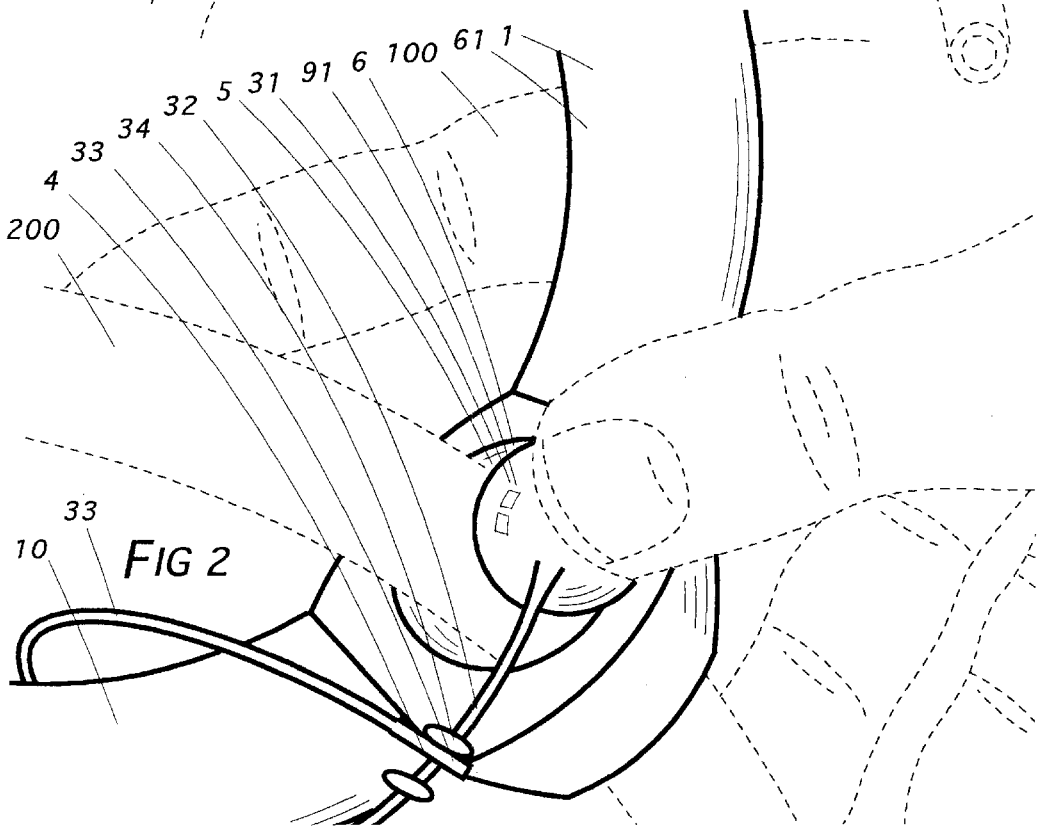
FIG. 2 illustrates an operator (100) shortening the effectual length of an exercise cord (200) by emplacing the impinger (3) into the elastic exercise member channel nest (5) of the assembly (10) so as to press against the cord (200) shown extended through the channel (5).

An impinger stem (32) interconnects the head (31) and tether (4) and may be of more or less indeterminate elongation. The stems (32) required for the loop connections shown in FIGS. 1–3 are shown to be longer than those (32) for the transverse

TABLE I

| PP5420 A1 GLASS REINFORCED HOMOPOLYMER 20% GLASS FIBER FILLER | |
|---|---|
| Tensile Strength[1] | 9,750 psi |
| Tensile Elongation[1] | 3% |
| Break[1] | 3% |
| Flexural Module Secant[2] | 500,000 psi |
| Flexural Module Tangent[2] | 750,000 psi |
| Heat Deflection 66 psi[3] | 305° F. |
| Heat Deflection 264 psi[3] | 285° F. |
| Specific Gravity[4] | 1.05 |
| Notched Izod Impact 23° C.[5] | 1.30 |
| Melt Flow 230° C./2.16 kg[6] | 10.0 |
| Linear Shrinkage[7] | 0.40% |

METHOD
[1]ASTM D638
[2]ASTM D790
[3]ASTM D648
[4]ASTM D792
[5]ASTM D258
[6]ASTM D1,238
[7]23° C./24 hrs/3.2 mm thick
Courtesy Ashland Chemical General Polymers 90 W. Chestnut St. Washington PA 15301 (412) 225-2220

TABLE II

| REXENE PP 18S2A POLYPROPYLENE COPOLYMER | | |
|---|---|---|
| Density[1] | 0.9000 | g/cm$^3$ |
| Melt Flow 230° C./2.16 kg[2] | 2.0 | g/10 min |
| Mold Shrink, Linear-Flow[3] | 0.015–0.025 | in/in |
| Tensile Modulus[4] | 170,000 | psi |
| Tensile Strength @ Yield[4] | 3,500 | psi |
| Tensile Elongation @ Brk[4] | 700% | |
| Flexural Modulus[5] | 160,000 | psi |
| Notched Izod Impact 73° F.[6] | 15.0 | ft-lb/in |
| Gardner Impact 73° C.[7] | 320 | in-lb |
| Gardner Impact −40° F.[7] | 300 | in-lb |
| Rockwell Hardness (R-Scale)[8] | 70.0 | |
| DTUL @ 66 psi-Unannealed[9] | 199° F. | |

METHOD
[1]ASTM D1,505
[2]ASTM D1,238
[3]ASTM D955
[4]ASTM D638
[5]ASTM D790
[6]ASTM D256
[7]ASTM D3,029
[8]ASTM D785
[9]ASTM D648
Courtesy IDES, Inc.

stopping connections shown in FIGS. 4–8 and 11. The stem (32) attached to the impinger stop (43), however, could be equal in length to that (32) of the tethering loop (33) without impeding function. Where stem (32) length is concerned, it is only necessary to insure that one (32) attached to a tethering loop (33) is sufficient to enable an operator (100) to tether it (32) easily. The stem (32) may be looped around any convenient part of the handgrip assembly (1), the stirrup (61) or strapping (600) for example, depending upon the configuration present. It (32) may, for example, be passed through one of the strap channels (22) or securing channels (23) in a connection bar (21).

In preferred embodiment, the tethering loop (33) is configured generally in the shape of a relatively small hook as shown in FIGS. 1–3, although it (33) may take any prior art form which accomplishes a connection which, though somewhat loose, is just tight enough to avoid its (33) slipping off. For example, the familiar serrated pin and frame combination of prior art may be employed.

In the embodiment shown in FIGS. 1–3, that which is preferred, the tethering loop (33) is retained in place by means of a pair of connector guides (34). These (34) comprise bumps, or protrusions, situated at a site along the general midlength of the stem (32). The exact disposition is a matter of preference and depends generally upon the size loop (32) desired. The two guides (34) are separated on the stem (32) by approximately ⅛–3⁄16 inch. The exact distance is not critical to function so long as they (34) are in position to prevent the connection from becoming undone.

The nest (5) within the member channel (6) disposed either in the body of the semi-rigid stirrup configured handgrip assembly (10) or the connection bar (21) of the strapped one (20), depending upon the embodiment being used, may comprise any form which facilitates the squeezing function of the impinger head (31). It may be tapered (700) as it is in prior art and shown in FIGS. 7 and 8, convex (52) as in FIG. 4, concave (51) as in FIG. 5, partially tapered (53) as in FIG. 6, or have any other convenient shape. A channel (6) comprising a straight or parallel wall is not preferred, however, because of the risk the impinger (3) might pull all of the way through it (6).

It should also be recognized that the connection bar (21), an important part of the strapped configured handgrip assembly (20) may also be employed in other assemblies such as exercise belts, headgear or other constructions which are fitted to some part of the operator's (100) body. Although not considered an emplaceable part of the assembly, usually requiring attachment by stitchwork in manufacture, it (21) may be considered as a separate novelty on its (21) own merit.

Figure 11:
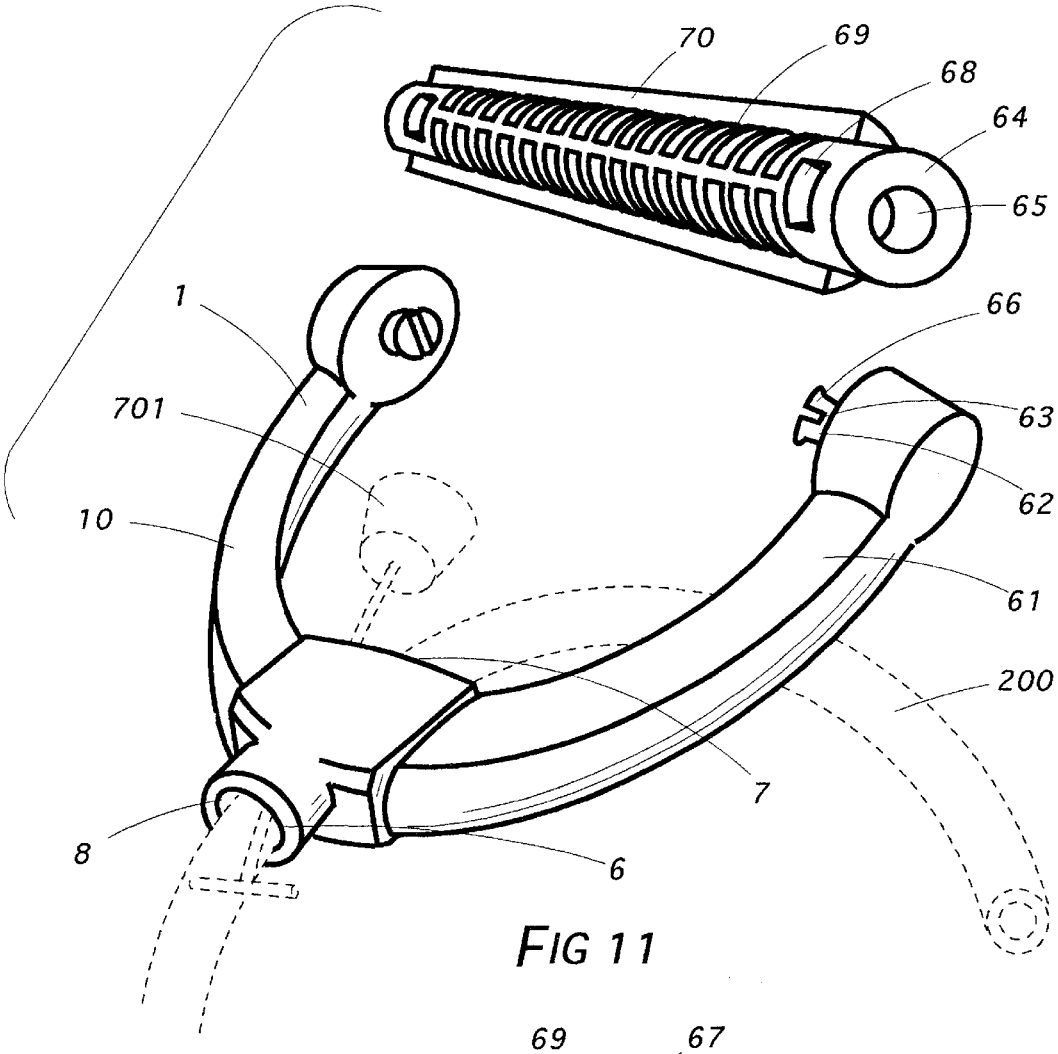
FIG. 11 is an explode view of a handgrip assembly comprising semi-rigid stirrup configuration depicting in separation the stirrup (61) and knurled rotable palm hold (64). A prior art truncated cone shaped impinger (701) is also shown.

In addition to the impinger (3) and nest (5), the handgrip assembly comprising semi-rigid stirrup configuration (10) which is the subject of this application also comprises a rotable knurled connection palm hold (64) capable of rigid emplacement within the handgrip stirrup (61). As shown in FIG. 11, this is accomplished by means of a connecting knode (62) transversely disposed at each tip of the stirrup (61) and a connecting well (65) disposed at the ends of the palm hold (64).

Figure 12:
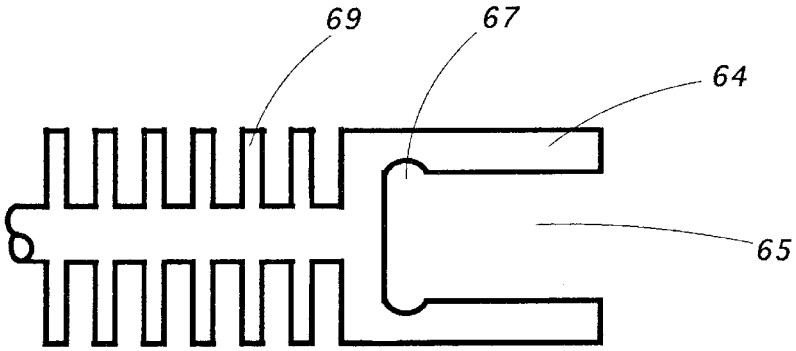
FIG. 12 represents the rotable palm hold (64) in partial longitudinal cross section, identifying the situs of the knurling groove (61) essential for firm retention of the palm hold (64) and stirrup (61) with one another.

Each connecting well (65) comprises a knurling groove (67) therein (65) preferably disposed at the inner or most inboard portion of the well (65). To visualize its (67) preferred situs, if the well (65) were considered to be oriented vertically so that the open end thereof (65) is at the top and the floor thereof (65) at the bottom, the knurling groove (67) would be disposed as a ring around the perimeter of the floor as shown in FIG. 12.

To connect the palm hold (64) to the tips of the stirrups (61), the knodes (62) are emplaced within the respective wells (65). To accomplish this, however, it is first necessary to bend the tips of the semi-rigid stirrups (61) slightly apart to allow room for initial placement of the palm hold (64). Both of the connective elements (62, 65) feature configuration which allows the two (62, 65) to become effectually snapped together. Specifically, the knode (62) comprises a knurled edge (66)—that is, a circumferentially disposed projecting ridge—at its innermost limit which just fits the knurling groove (67).

To further assist the snapping together of the two parts (61, 64), each knode (62) further comprises a compression slot (63), also shown in FIG. 11, which is of size and shape which just permits the two parts (61, 64) to become forced together.

Thus, to allow the knode (62) to become pushed into the well (65), the respective compression slot (63) is squeezed together so as to allow passage of the knode (62) into the well (65). Once the knurled edge (66) reaches the proximity of the knurling groove (67), it fills it (67), effectually locking the pieces (61, 64) together. The locking effect occurs because of the tension the well imposes upon the knode (62), squeezing the compression slot (63) together, while making the connection. Once the knode's knurled edge (66) reaches the knurling groove (67), the tension upon the compression slot (63) weakens, immediately allowing it (63) to reopen.

As the edge (66) reaches the groove's (67) depth, its (66) sudden expansion forces it (66) into the groove (67), allowing it (66) to be retained there. The strength of the retention makes it extremely difficult, absent the provision of particular means for the purpose, to separate the palm hold (64) from the stirrup (61). Despite such retention, the knode (62) is, nonetheless, free to spin or rotate at that site. It is this connection which permits rotability. It is considered that the connection is a matter of manufacture, since the operator (100) would presumably have little occasion to undo it.

The knurled connection palm hold (64) further comprises a molding window (68), shown in FIG. 11, which molding manufacturers prefer to properly form the well (65). The molding window (65), however, provides incidental assistance in disconnecting the connecting knode (62) from the well (65), should that become necessary, by providing screwdriver access to the innermost part of the well (65) so that the knode (62) can be pried out from it (65).

The embodiment of the palm hold (64) shown in FIGS. 11 and 12 further comprises numerous molding vanes (69) which confer integral strength upon the molded product, lighten the palm hold (64) and lower manufacturing cost.

Figure 7:
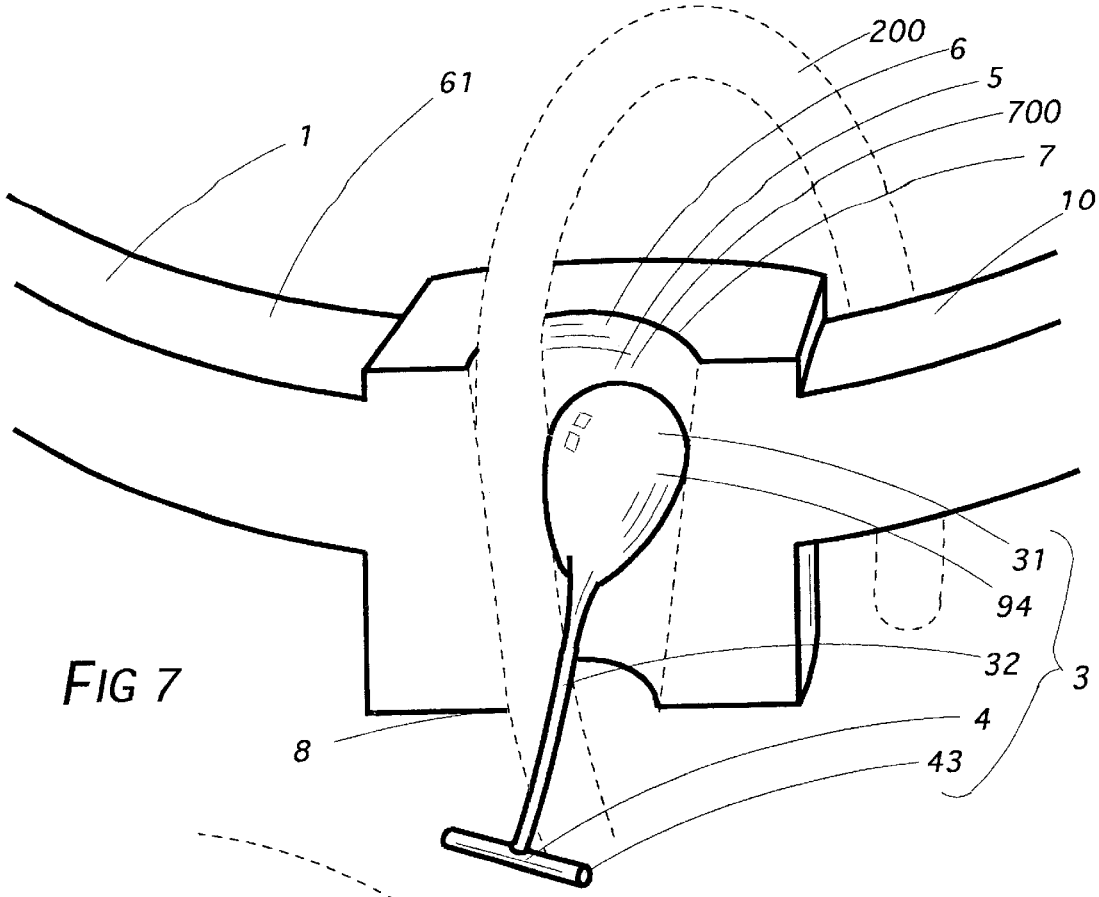
FIGS. 7 and 8 illustrate additional such cutaway views in which the first impinger is configured with an ovate head (94) and the second, with a bean shaped one (95). The nests (5) illustrated in both is tapered (100).
Figure 8:
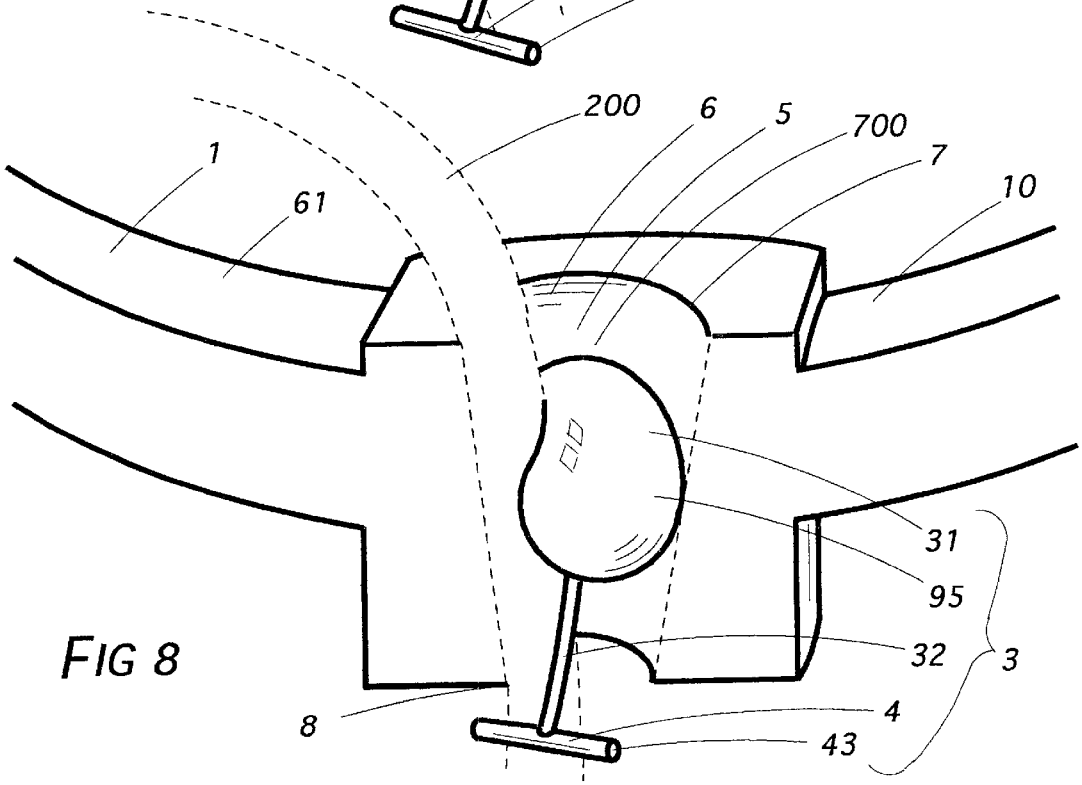
Figure 13:
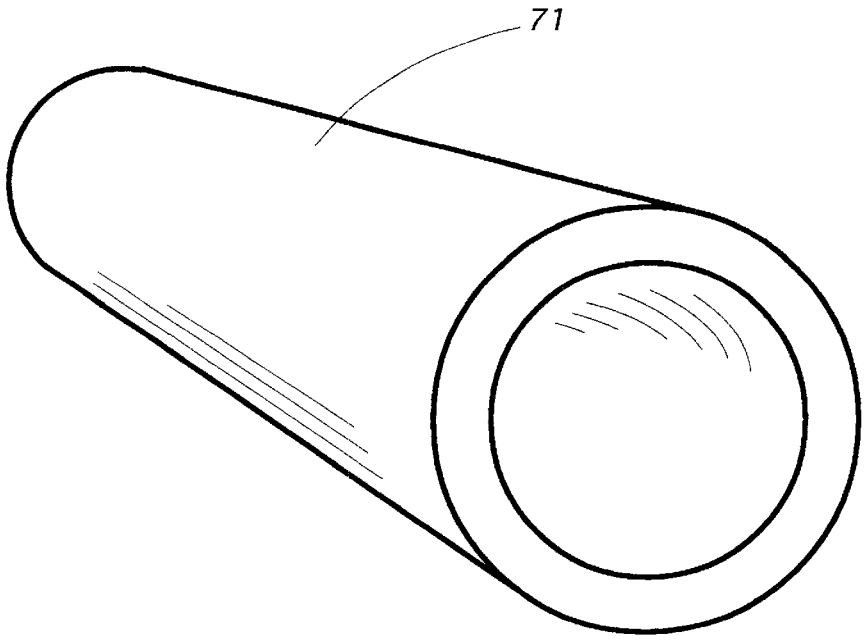
FIG. 13 comprises a rigid shell sleeve (71) which may be emplaced on the rotable palm hold (64) during manufacture before the handgrip parts are snap-fitted together.

To comfort the operator's grasp upon the rotable knurled palm hold (64), it is optional to enwrap it (64) with a foam sleeve (70), as shown in FIGS. 7 and 11, or with one comprising a rigid shell (71), as shown in FIG. 13. The foam sleeve (70) is more firmly retained in place by reason of the presence of the molding vanes (69), supra.

It should be recognized, of course, that where the rigid shell sleeve (71) is employed, the luxury of disassembly is forgone, since it (71) cannot be peeled back to reveal the molding window (68) for screwdriver access as in the case of the foam sleeve (70). Once the rigid sleeve (71) is emplaced in manufacture and the handgrip parts (61, 64) forced together, it is anticipated no one, whether manufacturer or operator (100), will ever undo them (61, 64). However, disassembly is no issue for those preferring the solid feel of a rigid shell sleeve (71) enwrapped by the rotable palm hold (64).

Figure 14:
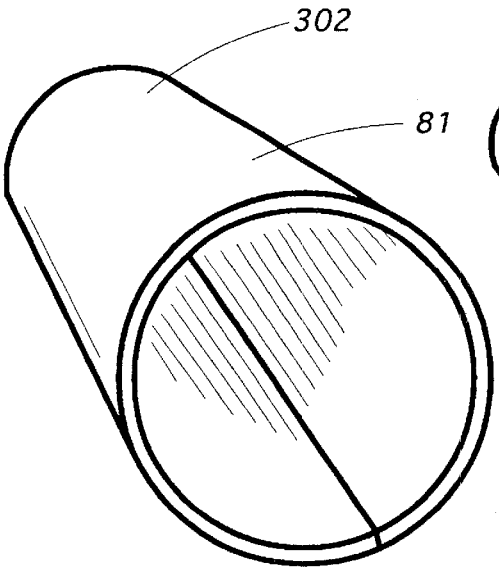
FIGS. 14 and 15 depict a longitudinally split shell sleeve in the biased closed, FIG. 14, and forced open, FIG. 15, configurations.
Figure 15:
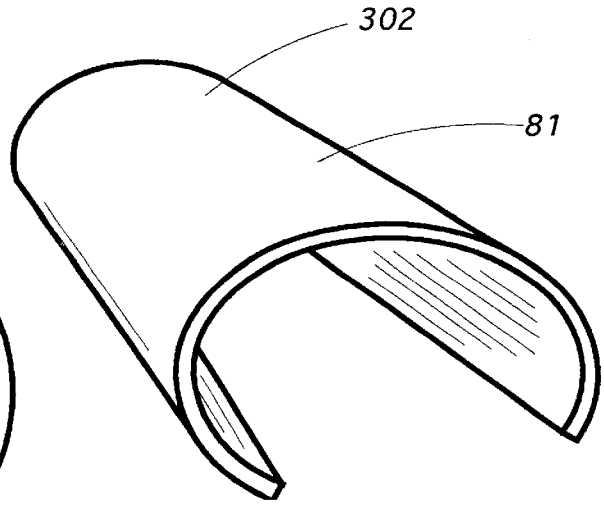
Figure 16:
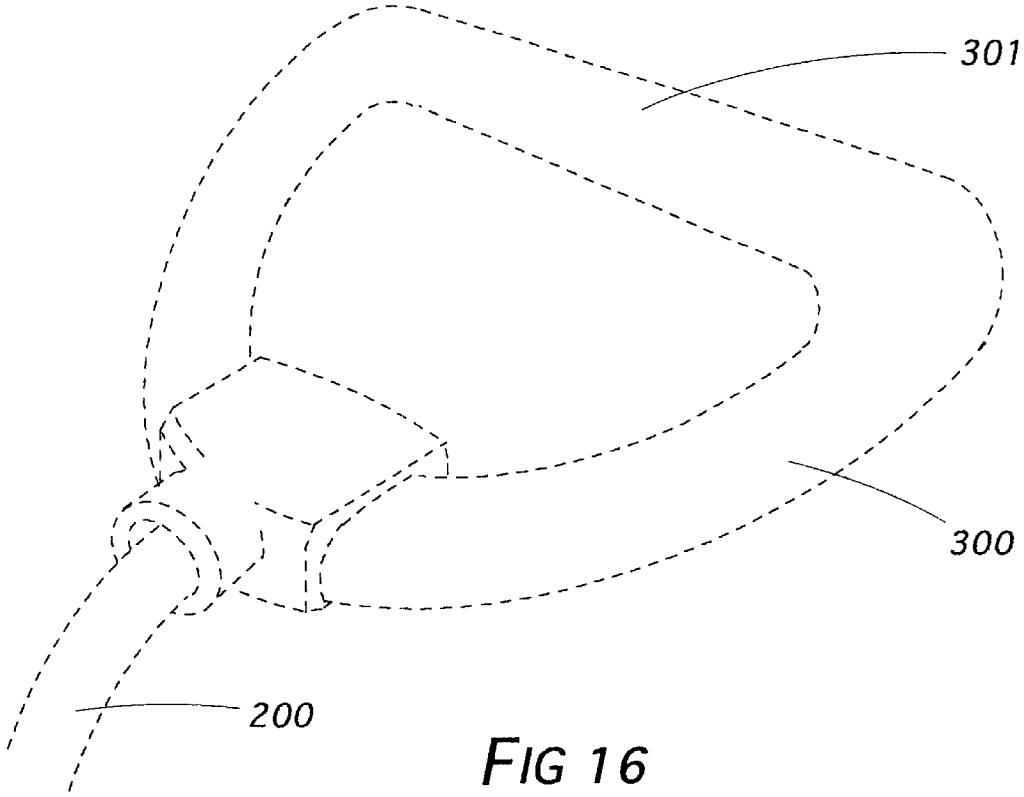
FIG. 16 represents a prior art one-piece rigid stirrup handgrip (300) and FIG. 17, a longitudinally split shell sleeve (81) loosely enwrapping and providing rotability for it (300).
Figure 17:
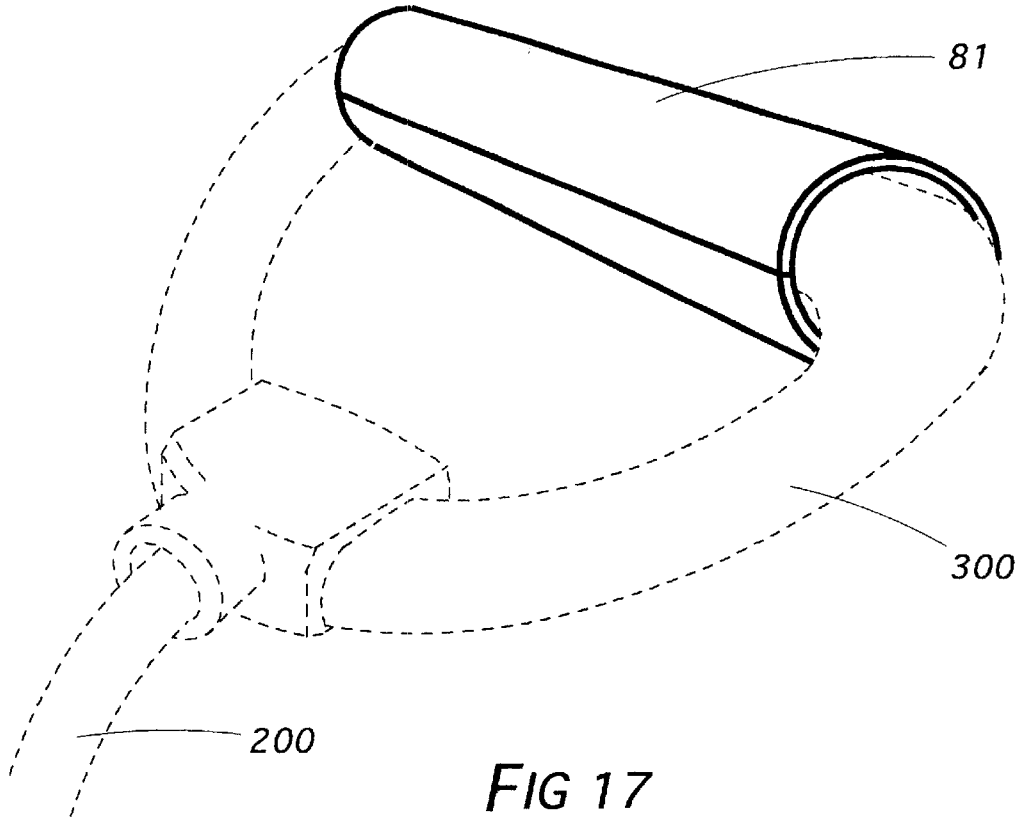

While it is readily recognized the strapped handgrip (400) of prior art are provided with rotability by reason of a tubular rotable palm hold (302), supra, even the prior art one-piece rigid stirrup handgrip (300) shown in FIG. 16, by reason of the disclosure herein, may also be so embellished. Featured herein is a longitudinally split shell sleeve (81) illustrated in FIGS. 14, 15 and 17. It (81) is biased in a closed complete tubular configuration made possible by materials of selected flexibility and strength which confer what is sometimes termed "memory" upon certain products. Once the split sleeve (81) is forced open sufficiently, as shown in FIG. 15, a task accomplished by continually improving manufacturing techniques, it (81) may be forced over the one-piece handgrip's palm hold (301) and then allowed to resume its (81) former configuration, thereby encircling the palm hold (301). In conducting exercise, the palm hold (301) remains secure in the operator's (100) grasp despite rotational stresses imposed upon the assembly by reason of various exercises.

The inventor hereby claims:

1. An adjustable exercise handgrip assembly comprising:

an elastic exercise member impinger in turn comprising a head;

a stem; and a tether comprising one of a tethering loop; and a stop;

the adjustable exercise handgrip assembly further comprising one of semi-rigid stirrup configuration; and strapped configuration;

each handgrip assembly of semi-rigid stirrup configuration comprising an elastic exercise member channel in turn comprising an impinging nest;

each handgrip assembly of strapped configuration comprising a tubular palm hold;

handgrip strapping; and a connection bar comprising a pair of strap channels;

a pair of securing channels; and an elastic exercise member channel in turn comprising an impinging nest;

whereby an operator, upon inserting a portion of the elastic exercise member through a selected elastic member channel of either handgrip configuration and emplacing the impinger within the channel nest, may quickly change the effectual length of the elastic member or interchange it with another.

2. The adjustable exercise handgrip assembly according to claim 1 wherein the impinging nest comprises concave configuration.

3. The adjustable exercise handgrip assembly according to claim 1 wherein the impinging nest comprises convex configuration.

4. The adjustable exercise handgrip assembly according to claim 1 wherein the impinging nest comprises partially tapered configuration.

5. The adjustable exercise handgrip assembly according to claim 1 wherein the impinger head comprises spherical configuration.

6. The adjustable exercise handgrip assembly according to claim 1 wherein the impinger head comprises truncated spherical configuration.

7. The adjustable exercise handgrip assembly according to claim 1 wherein the impinger head comprises lozenge shaped configuration.

8. The adjustable exercise handgrip assembly according to claim 1 wherein the impinger head comprises ovate configuration.

9. The adjustable exercise handgrip assembly according to claim 1 wherein the impinger head comprises bean shaped configuration.

10. The adjustable exercise handgrip assembly according to claim 1 wherein the elastic member impinger tethering loop comprises hook configuration.

11. The adjustable exercise handgrip assembly according to claim 1 wherein the elastic member impinger stem comprises a pair of impinger connector guides disposed such that the tethering loop may be seated between them.

12. The adjustable exercise handgrip assembly comprising semi-rigid stirrup configuration according to claim 1, the stirrup thereof further comprising a connecting knode comprising in turn a knurled edge; and a compression slot;

the exercise assembly further comprising a rotable knurled connection palm hold comprising in turn a connecting well comprising in turn a knurling groove;

whereby, upon connecting the knode and well and seating the knurling edge seats within the knurling groove, the knode is permitted to rotate within the groove such that the palm hold remains in fixed position within the operator's grasp during exercises imposing rotational stress upon it.

13. The adjustable exercise handgrip assembly comprising semi-rigid stirrup configuration according to claim 12 wherein the rotable knurled palm hold further comprises a molding window; whereby molding of the palm hold during manufacture is enhanced.

14. The adjustable exercise handgrip assembly comprising semi-rigid stirrup configuration according to claim 12 wherein the rotable knurled palm hold further comprises a molding vanes; whereby the palm hold's structural integrity is strengthened.

15. The adjustable exercise handgrip assembly comprising semi-rigid stirrup configuration according to claim 12 wherein the rotable knurled palm hold is enwrapped by a foam sleeve.

16. The adjustable exercise handgrip assembly comprising semi-rigid stirrup configuration according to claim 12 wherein the rotable knurled palm hold is enwrapped by a rigid shell sleeve.

* * * * *